US005196760A

United States Patent [19]

Takamura et al.

[11] Patent Number: 5,196,760

[45] Date of Patent: Mar. 23, 1993

[54] SPARK PLUG FOR INTERNAL COMBUSTION ENGINE WITH PILLAR SHAPED ELECTRODE

[75] Inventors: Kozo Takamura, Nagoya; Kiyoaki Tanaka, Numazu, both of Japan

[73] Assignee: Nippondenso Co., Ltd., Kariya, Japan

[21] Appl. No.: 634,241

[22] Filed: Dec. 26, 1990

[30] Foreign Application Priority Data

Dec. 27, 1989 [JP] Japan ..... 1-343736

[51] Int. Cl.[5] ..... H01T 13/20

[52] U.S. Cl. ..... 313/142; 313/141

[58] Field of Search ..... 313/139, 141, 142

[56] References Cited

U.S. PATENT DOCUMENTS

| | | | |
|---|---|---|---|
| 1,080,089 | 12/1913 | Walker et al. | 313/141 |
| 1,425,329 | 8/1918 | Mellblom | 313/142 |
| 1,486,710 | 6/1923 | Whittier | 313/142 |
| 2,959,703 | 11/1960 | Hastings . | |
| 3,009,075 | 11/1961 | Hensley . | |
| 4,229,672 | 10/1980 | Trancik | 313/139 |

FOREIGN PATENT DOCUMENTS 50-60445 2/1975 Japan .

*Primary Examiner*—Donald J. Yusko

*Assistant Examiner*—John Giust

*Attorney, Agent, or Firm*—Cushman, Darby & Cushman

[57] ABSTRACT

A spark plug for an internal combustion engine includes a central electrode, and an earth electrode disposed in opposed relation to the central electrode on an axis of the central electrode to thereby form a spark gap between the central electrode and the earth electrode. The central electrode has a pillar-like portion provided at a distal end thereof disposed close to the spark gap, the pillar-like portion having a predetermined thickness corresponding to an intended lifetime of the spark plug. The central electrode also has a smaller-diameter portion disposed adjacent to a proximal end of the pillar-like portion, the smaller-diameter portion being smaller in diameter than the pillar-like portion. The pillar-like portion and the smaller-diameter portion are interconnected in a step-like manner. A step portion may be provided between the pillar-like portion and the smaller-diameter portion so as to limit the position of a spark discharge. The central electrode may have a pillar-like shape, in which case the central electrode is radially inwardly reduced intermediate opposite ends thereof to form the smaller-diameter portion, so that the distal end portion of the central electrode disposed close to the earth electrode is formed into the pillar-like portion.

11 Claims, 6 Drawing Sheets

SPARK PLUG FOR INTERNAL COMBUSTION ENGINE WITH PILLAR SHAPED ELECTRODE

BACKGROUND OF THE INVENTION

This invention relates to a spark plug for use in an internal combustion engine for an automobile or the like.

Recently, in the automobile industry, positive efforts have been made in order to achieve a high performance design of an engine (particularly, a low fuel consumption and a high output power). There is a tendency that the air/fuel mixture to be supplied to the engine is leaner, and there is also a tendency that the compression ratio is higher. Therefore, the voltage (hereinafter referred to as "required voltage") for producing a discharge across a spark gap becomes higher with the same spark gap. Naturally, with the increase of the running distance, the spark gap increases because of the consumption of an electrode, so that the required voltage increases. The rate of increase of the required voltage is high in the type of engine having a lean air/fuel ratio and a high compression ratio. The voltage to be supplied to the spark gap is determined by coil characteristics, and therefore if the required voltage exceeds the coil generating voltage, a firing occurs. Two methods of overcoming this difficulty can be considered. Namely, one is to increase the generating voltage, and the other is to decrease the required voltage for the spark gap. The former method has a disadvantage that the voltage resistance at the connecting portions of a distributor, a high-voltage cord, the coil and the spark plug becomes less reliable.

SUMMARY OF THE INVENTION

It is therefore an object of this invention to provide a spark plug capable of lowering the required voltage.

According to one aspect of the present invention, there is provided a spark plug for an internal combustion engine comprising a central electrode, and an earth electrode disposed in opposed relation to the central electrode on an axis of the central electrode to thereby form a spark gap between the central electrode and the earth electrode; wherein the central electrode has a pillar-like portion provided at a distal end thereof disposed close to the spark gap, the pillar-like portion having a predetermined thickness corresponding to an intended lifetime of the spark plug; the central electrode also has a smaller-diameter portion disposed adjacent to a proximal end of the pillar-like portion, the smaller-diameter portion being smaller in diameter than the pillar-like portion; and the pillar-like portion and the smaller-diameter portion are interconnected in a step-like manner.

According to another aspect of the invention, there is provided a spark plug for an internal combustion engine comprising:

a pillar-like central electrode; and an earth electrode disposed in opposed relation to the central electrode on an axis of the central electrode to thereby form a spark gap between the central electrode and the earth electrode;

the central electrode being radially inwardly reduced intermediate opposite ends thereof to form a smaller-diameter portion, so that a distal end portion of the central electrode disposed close to the earth electrode is formed into a pillar-like portion having a predetermined thickness corresponding to an intended lifetime of the spark plug.

According to a further aspect of the invention, there is provided a spark plug for an internal combustion engine comprising a central electrode, and an earth electrode disposed in opposed relation to the central electrode on an axis of the central electrode to thereby form a spark gap between the central electrode and the earth electrode; wherein the central electrode has a pillar-like portion provided at a distal end thereof disposed close to the spark gap, the pillar-like portion having a predetermined thickness corresponding to an intended lifetime of the spark plug; the central electrode also has a smaller-diameter portion disposed adjacent to a proximal end of the pillar-like portion, the smaller-diameter portion being smaller in diameter than the pillar-like portion; and the central electrode further has a step portion disposed between and interconnecting the pillar-like portion and the smaller-diameter portion, the step portion serving to limit the position of a spark discharge to be produced between the earth electrode and the step portion.

DESCRIPTION OF THE PREFERRED EMBODIMENTS

An example of the present invention embodied in a spark plug for an automobile engine will now be described with reference to the drawings.

Figure 2:
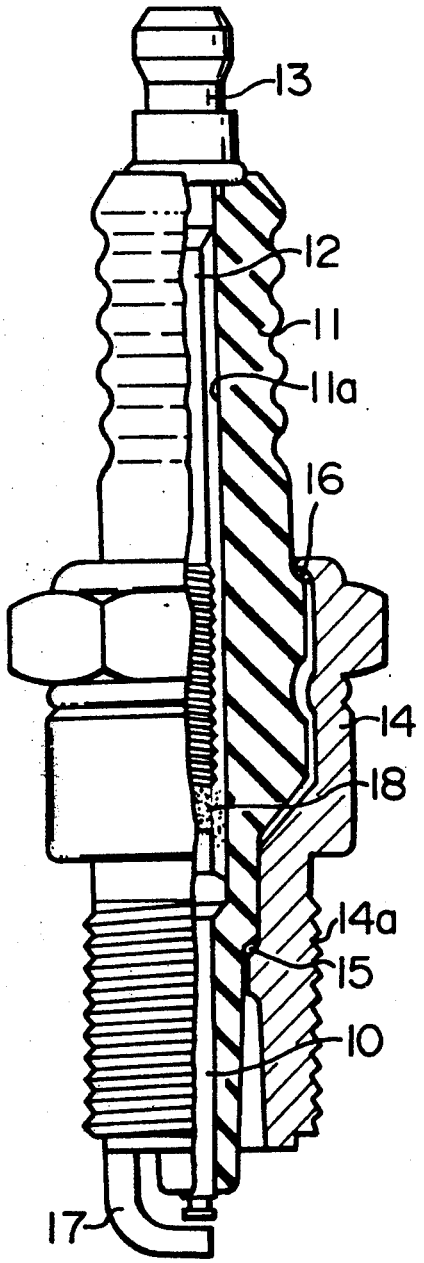
FIG. 2 is a view showing the overall construction of the spark plug.

FIG. 2 shows the overall construction of the spark plug of this embodiment. A central electrode 10 is made of base metal (e.g. Ni-Cu) having heat resistance, corrosion resistance and electrical conductivity. The distal end portion of the central electrode 10 serving as a spark portion is retained by an insulator 11. A central stem 12 of carbon steel is received in an upper portion of an axial hole 11*a* of the insulator 11. A terminal 13 of brass or the like is fixedly threaded on the head of the central stem 12. A cylindrical housing 14 is made of metal having heat resistance, corrosion resistance and electrical conductivity, and the insulator 11 is received in the housing 14, and is fixed thereto through a ring-shaped sealing packing 15 and a clamping ring 16. The housing 14 has a threaded portion 14*a* by which the housing 14 is fixed to an engine block.

An earth electrode 17 is fixedly secured to the lower end surface of the housing 14 by welding, the earth electrode 17 being made of metal having heat resistance, corrosion resistance and electrical conductivity. An electrically-conductive glass sealing layer 18 is sealed in the axial hole 11*a* of the insulator 11. The electrically-conductive glass sealing layer 18 is made of copper powder and low-melting glass. The central stem 12 and the central electrode 10 are electrically connected together by the sealing layer 18, and also the central stem 12 and the central electrode 10 are fixed to the axial hole 11*a* of the insulator 11 by the sealing layer 18.

Figure 1:
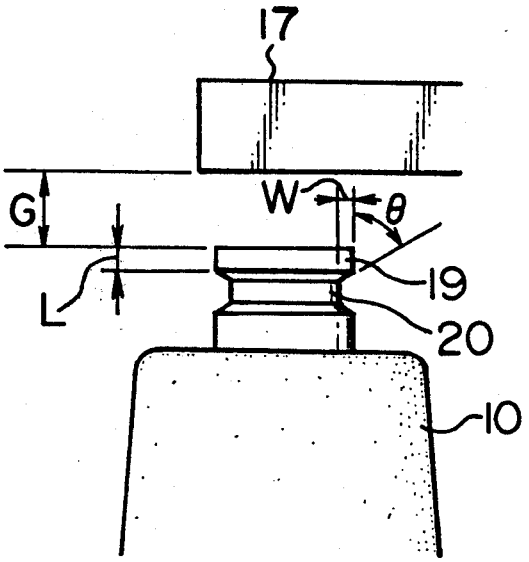
FIG. 1 is a view of a discharge portion of a spark plug of the present invention for an internal combustion engine.

FIG. 1 shows the distal end portion of the central electrode 10 of the spark plug of this embodiment. The central electrode 10 has a pillar-like portion 19 formed at its distal end (discharge side). The pillar-like portion 19 has a uniform cross-sectional area in the direction of the axis of the central electrode 10, and has a predetermined thickness corresponding to an intended lifetime of the spark plug. The central electrode 10 also has a smaller-diameter portion 20 of a constricted shape formed adjacent to the proximal end of the pillar-like portion 19. The smaller-diameter portion 20 is formed by circumferentially cutting the outer periphery surface of the central electrode 10. With this configuration, the increase of a spark gap G can be kept to such a level as experienced in a conventional spark plug having a central electrode of a cylindrical shape. And besides, the required voltage can be decreased by suitably determining a thickness L of the pillar-like portion 19, a radial dimension W of a step portion between the pillar-like portion 19 and the smaller-diameter portion 20, and the angle $\theta$ between the surface of this step portion and a line extending in the direction of the axis of the central electrode 10.

The inventor of the present invention has examined the spark conditions of the spark plug in detail, and has found a new phenomenon which will be described in the following.

Figure 3:
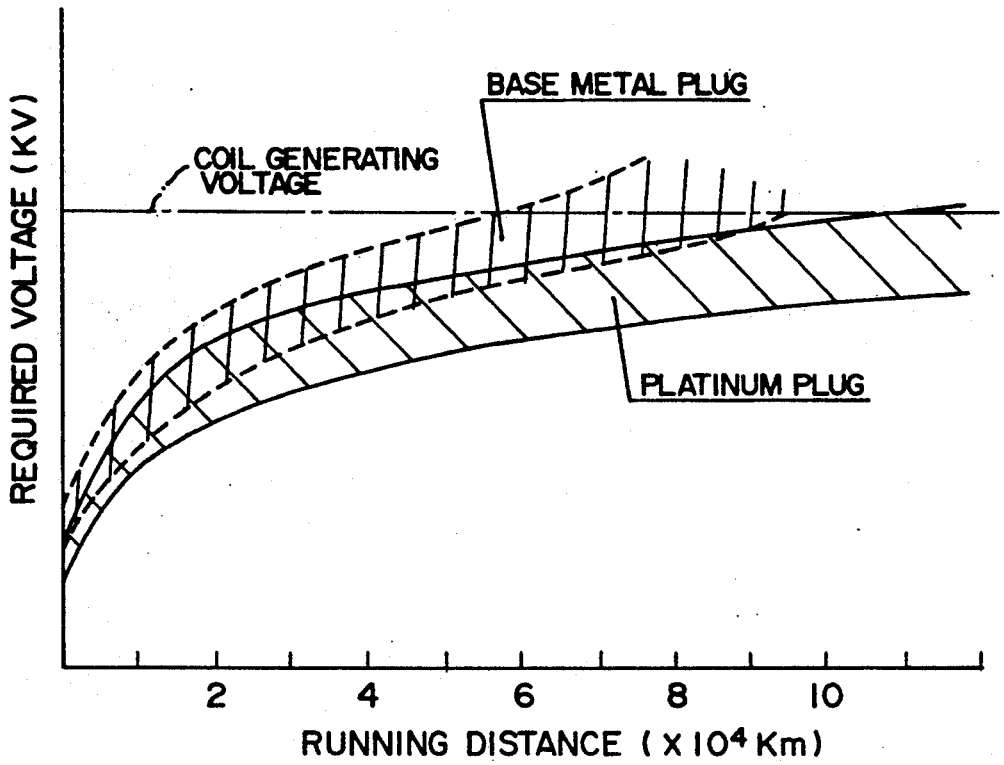
FIG. 3 is a graph showing the relation between a required voltage and a running distance.
Figure 4:
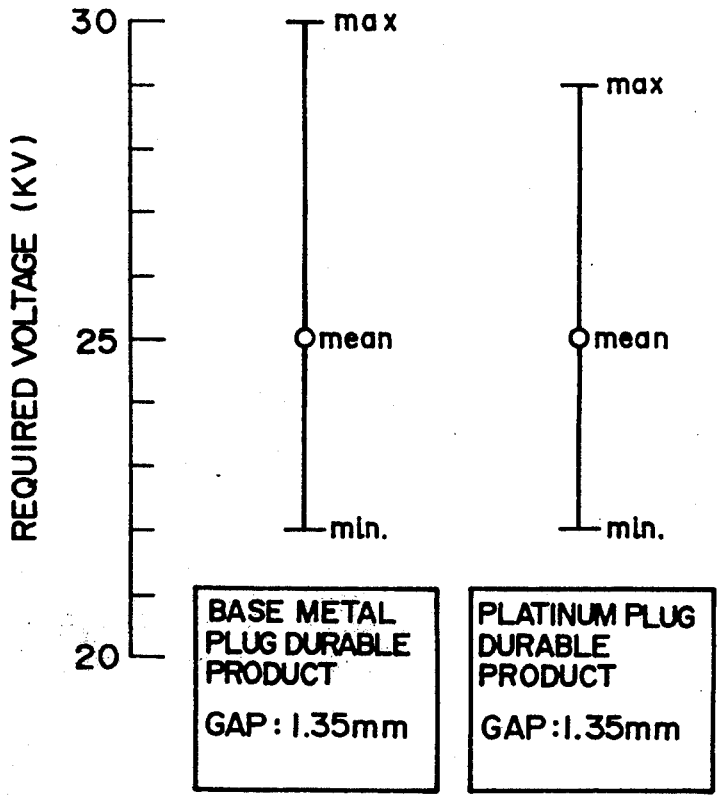
FIG. 4 is an illustration showing distributions of required voltages of spark plugs.

The spark gap G of the spark plug mounted on a vehicle increases with the increase of the running distance of the vehicle, and the duration of lifetime of the spark plug expires at the time when the required voltage reaches the coil generating voltage. FIG. 3 shows the transitions of the required voltages with respect to a base metal plug employing a Ni-based alloy as electrode material and a platinum plug having a platinum alloy tip. The duration of lifetime of the base metal plug expires with the running distance of 50,000 km, and the duration of lifetime of the platinum plug expires with the running distance of 100,000 km. The value of the required voltage fluctuates each time the discharge occurs, and therefore is subjected to variations. In FIG. 3, the amplitude between the maximum value and minimum value of the required voltage is shown. FIG. 4 shows the required voltages of the spark plug obtained when the spark plug is in a durable configuration (i.e., when the spark plug is used with the edge of the central electrode removed).

Figure 5:
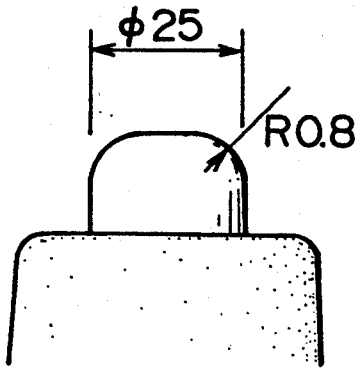
FIG. 5 is a view of a distal end portion of a central electrode of a spark plug used for a test.
Figure 6:
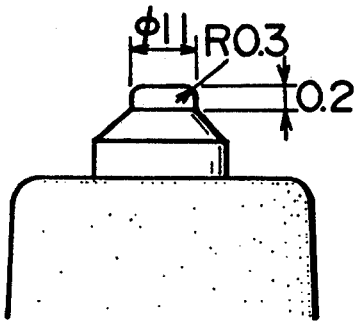
FIG. 6 is a view of a distal end portion of a central electrode of a spark plug used for a test.

As shown in FIG. 5, the base metal plug had the central electrode with a diameter of 2.5 mm. As shown in FIG. 6, the platinum plug had the platinum alloy tip with a diameter of 1.1 mm. The value of the required voltage was measured when a discharge was made in a sealed container filled with the air of 6 kg/cm$^2$.

As shown in FIG. 4, the difference between the maximum value and the mean value is considerably greater than the difference between the mean value and the minimum value. Therefore, the cause of such difference was studied in detail in connection with the spark conditions.

FIGS. 7 to 10 show the spark conditions in the sealed container filled with the air of 6 kg/cm$^2$. The spark gap in FIGS. 7 to 10 was set to 1.35 mm.

Figure 7:
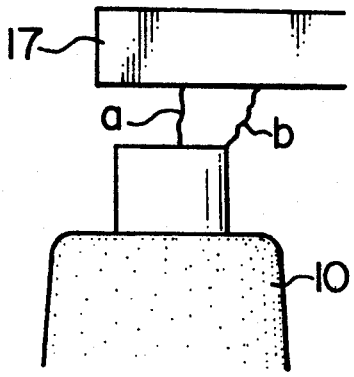
FIGS. 7, 8, 9 and 10 are views showing spark conditions.
Figure 8:
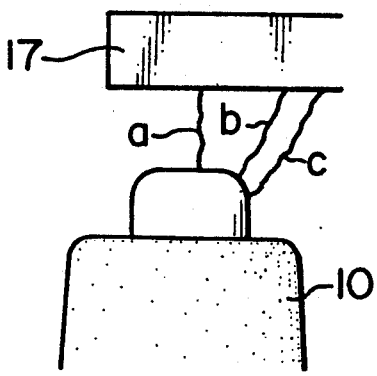
Figure 9:
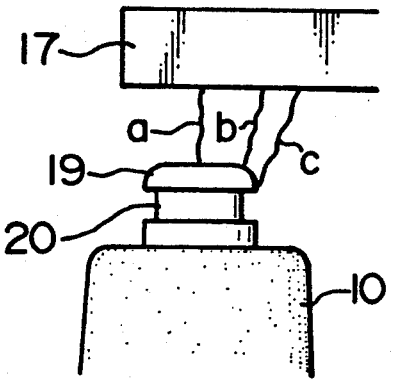
Figure 10:
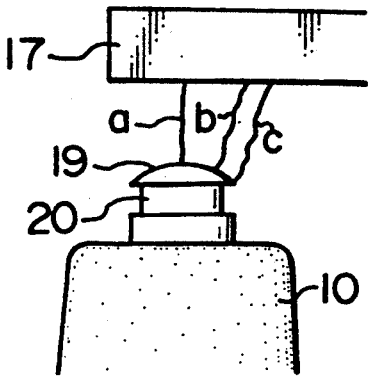

FIG. 7 shows a plug having a new central electrode of a cylindrical shape. FIG. 8 shows the plug of FIG. 7 with the edge of the central electrode removed. FIGS. 9 and 10 show plugs of this embodiment, respectively. In FIGS. 7 to 10, the discharge path is broadly classified into two paths, that is, a path a along which the spark is applied from the end face of the central electrode 10 and a path b along which the spark is applied obliquely from the edge of the distal end of the central electrode 10.

The configuration of the central electrode 10 greatly influences the required voltage, and it is known that the distal end of the central electrode 10 is consumed generally into a round or semi-spherical shape. This is thought to be due to the fact that initially, the frequency of occurrence of the spark is high at the distal end edge, so that this edge portion is rounded to have a curvature, and thereafter the spark-producing region is divided into this curvature edge portion and the end face, and in this condition the consumption of the electrode proceeds. Then, as indicated by a spark path c in FIG. 8, a spark is produced, starting from the proximal side of the edge portion whose radius of curvature increases as the plug is used. This spark path c has a greater discharge path than the spark paths a and b have. This discharge path c becomes longer since the edge portion has a greater radius of curvature with the increase of the electrode consumption. Therefore, the spark path c provides a disadvantage from the viewpoint of the voltage. Therefore, it is surmised from a comparison between the variations of the required voltages in FIG. 4 that the maximum value is influenced by the spark path c.

On the other hands, in FIGS. 9 and 10, as in FIG. 8, spark paths a, b and c are also seen; however, the spark starting from the curvature portion and extending along the spark path c has a feature. More specifically, because the pillar-like portion 19 and the smaller-diameter portion 20 are provided at the distal end portion of the central electrode 10, the point of start of the spark produced along the spark path c is limited to the end of the pillar-like portion 19 close to the smaller-diameter portion 20. Therefore, from the viewpoint of the length of the discharge path, the maximum value of the required voltage can be suppressed.

In addition, since the extent of the spark is limited to within the thickness L of the pillar-like portion 19, the consumed amount of the edge of the central electrode is the value of the thickness L at the maximum, and therefore is smaller than that of the conventional plug of FIG. 8. This is advantageous from the viewpoint of the voltage.

Further, the thickness L of the pillar-like portion 19 was changed from 0.3 mm to 0.2 mm so as to extremely increase a radius of curvature of its edge portion to thereby provide an example of extremely-consumed plug, and this plug was observed. As a result, it has been confirmed that the discharge path lengths of the spark paths a, b and c necessarily tended to be analogous to one another.

Figure 11:
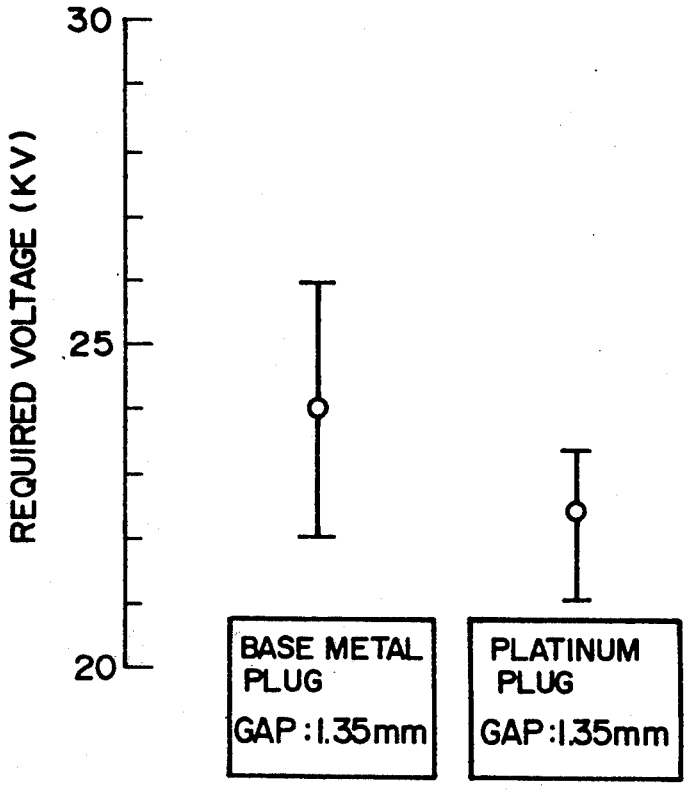
FIG. 11 is an illustration showing distributions of required voltages.
Figure 12:
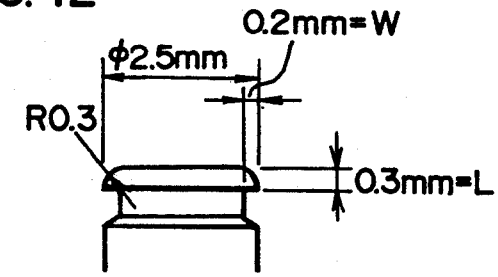
FIGS. 12 and 13 are views of distal end portions of central electrodes of spark plugs used for a test.
Figure 13:
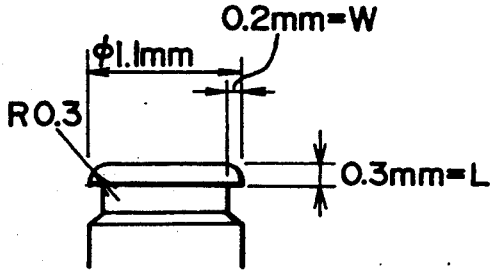

It has also been confirmed through tests that the discharge voltage at the spark path c in FIGS. 9 and 10 approaches the voltage values at the spark paths a and b because of the edge effect, thereby advantageously suppressing the variations of the required voltage, that is, suppressing the maximum value thereof. The results obtained are shown in FIG. 11. Referring to the specifications used in this test, as a base metal plug using Ni-alloy as the electrode material, there was used one (shown in FIG. 12) having a central electrode with a diameter of 2.5 mm, and as a platinum alloy plug, there was used one (shown in FIG. 13) having a platinum alloy tip with a diameter of 1.1 mm. The parameters of each test plug were as follows: L=0.3 mm; the radius R of curvature of the distal end edge =0.3 mm; W =0.2 mm; $\theta=90°$; the spark gap G=1.35 mm. As will be appreciated from the comparison between FIG. 11 and FIG. 4, the minimum value was unchanged since it depends on the spark gap at the spark path a; however, the maximum value suddenly occurring was decreased about 4 KV with respect to the plug of FIG. 12, and also the maximum value was decreased about 6 KV with respect to the plug of FIG. 13.

Figure 14:
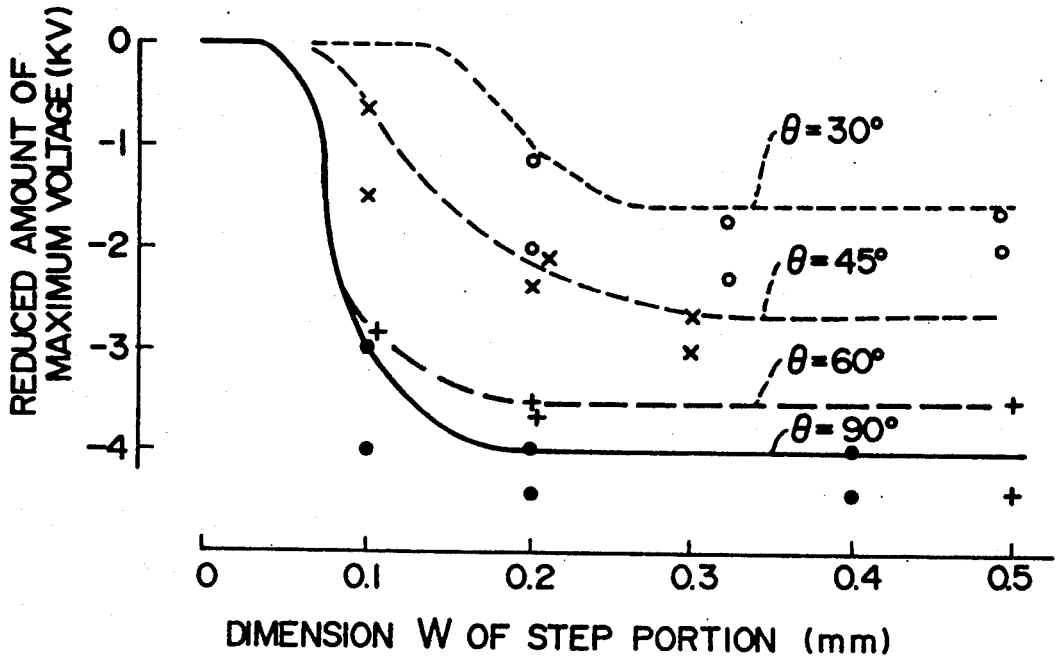
FIG. 14 is a graph showing the relation between the dimension of a step and a reduced value of a required voltage.
Figure 15:
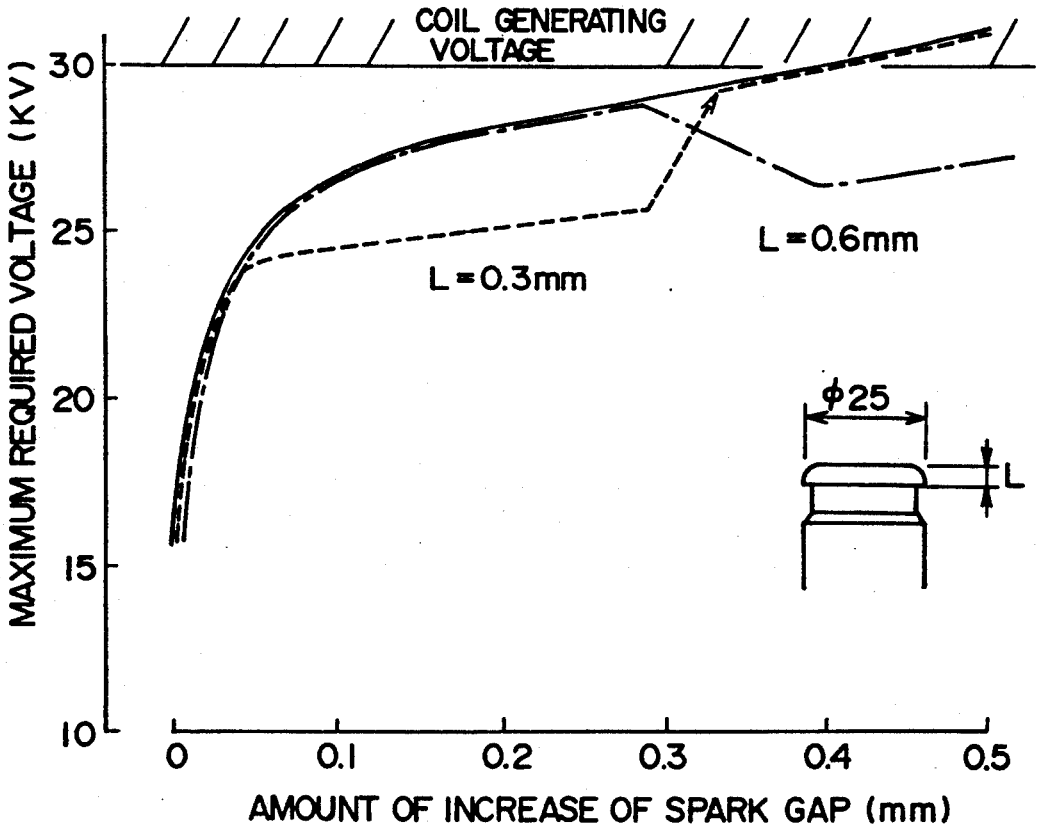
FIG. 15 is a graph showing the relation between the amount of increase of a spark gap and the required voltage.
Figure 16:
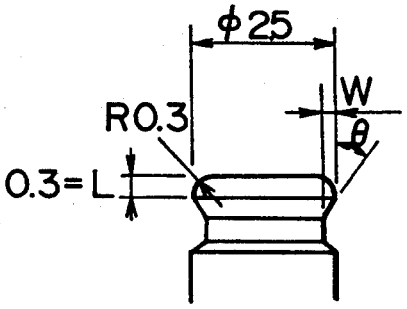
FIG. 16 is a view of a distal end portion of a central electrode of a spark plug used for a test.

FIGS. 14 and 15 show the results of tests with respect to the configurations of pillar-like portion 19 and smaller-diameter portion 20. FIG. 14 shows data of plugs (FIG. 16) each having a central electrode of Ni-based alloy having a diameter of 2.5 mm, and the thickness L of the pillar-like portion was 0.3 mm, and the radial dimension W of a step portion between the pillar-like portion and the smaller-diameter portion and the angle $\theta$ of this step portion were used as factors. As is clear from the test results shown in FIG. 14, variations in the maximum value of the required voltage can be better suppressed by the provision of the pillar-like portion 19 and the smaller-diameter portion 20, as compared with the conventional plug. When the dimension W of the step portion is not less than 0.1 mm and also $\theta$ is not less than 30°, the effects are achieved. In the case of $W \leqq 0.2$ mm, the effects can be expected when the angle $\theta$ of the step portion is in the range of between 60° and 90° ($60° \leqq \theta \leqq 90°$). Also, in the case of $W > 0.2$ mm, the effects can be expected when $30° \leqq \theta \leqq 90°$ is provided.

FIG. 15 shows the transition of the required voltage with respect to the amount of increase of the spark gap. FIG. 15 shows data of plugs each having a cylindrical central electrode of Ni-based alloy, and a broken line indicates the plug whose pillar-like portion had a thickness L of 0.3 mm, and a dot-and-dash line indicates the plug whose pillar-like portion had a thickness L of 0.6 mm. In the plug whose pillar-like portion 19 had the thickness L of 0.3 mm, when the amount of increase of the spark gap is not less than 0.05 mm, the maximum value of the required voltage can be suppressed, and the maximum value coincides with the value indicated by a solid line when the electrode consumption proceeds to 0.3 mm. In the plug whose pillar-like portion 19 had the thickness L of 0.6 mm, the effect of decreasing the maximum value of the required voltage begins to appear from the time when the electrode consumption reaches the level of 0.3 mm, and subsequently the maximum value is kept decreased. In the case where L is more than 0.6 mm, the maximum value of the required voltage reaches the coil generating voltage before the effect appears, which results in a possibility that a trouble such as firing may occur.

Therefore, it is preferred that the thickness L of the pillar-like portion of the plug having the central electrode of Ni-based alloy should be in the range of between 0.3 mm and 0.6 mm. However, in the case where the plug is limited to the type designed to be used for a short time, the thickness L of less than 0.3 mm can be adopted. With respect to a platinum plug using a platinum alloy tip, it has been confirmed that the amount of increase of the spark gap is about 0.2 mm after the running of 100,000 km, and in this case it is preferred that the thickness L of its pillar-like portion should be not less than 0.2 mm. Referring to FIG. 15, the evaluations were made in a sealed container of an air pressure of 6 kg/cm$^2$, using specifications shown in FIG. 15.

As described above, in this embodiment, the pillar-like portion 19, which has a uniform cross-sectional area in the axial direction of the central electrode and has a predetermined thickness corresponding to an intended lifetime of the spark plug, is formed on the distal end of the central electrode 10, and further the smaller-diameter portion 20 smaller in diameter than the pillar-like portion 19 is formed adjacent to the proximal end of the pillar-like portion 19. As a result, the discharge concentrates on the edge portion of the central electrode 10 to consume the edge portion of the pillar-like portion 19; however, the point of start of the spark at the central electrode 10 is limited to the end face of the pillar-like portion 19 close to the smaller-diameter portion 20. Therefore, because of the length of the discharge path, the maximum value of the required voltage is suppressed, and also the amount of consumption of the electrode is suppressed.

Further, when the radial dimension W of the step portion between the pillar-like portion 19 and the smaller-diameter portion 20 is not less than 0.1 mm as shown in FIG. 14, and also the thickness L of the pillar-like portion 19 is not more than 0.6 mm as shown in FIG. 15, the optimum results can be obtained.

Further, as shown in FIG. 14, when the radial dimension W of the step portion between the pillar-like portion 19 and the smaller-diameter portion 20, and the angle $\theta$ between the surface of this step portion and the axial line are determined as follows, the optimum results can be obtained:

In the case of 0.1 mm $\leqq W \leqq 0.2$ mm, $60° \leqq \theta 90°$.

In the case of $W > 0.2$ mm, $30° \leqq \theta \leqq 90°$.

Figure 17:
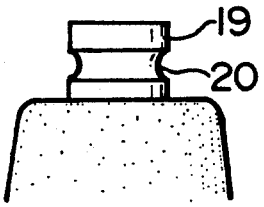
FIG. 17 is a view of a distal end portion of a central electrode of a modified spark plug.
Figure 18:
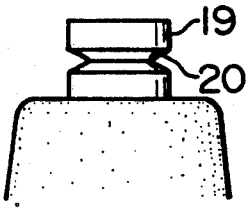
FIG. 18 is a view similar to FIG. 17, but showing another modified form of the invention.
Figure 19:
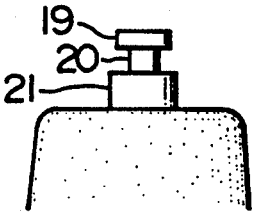
FIG. 19 is a view similar to FIG. 17, but showing a further modified form of the invention.

The present invention is not to be restricted to the above embodiment. For example, the smaller-diameter portion 20 may be formed by providing a peripheral notch having an arcuate cross-section as shown in FIG. 17, or by providing a peripheral notch of a V-shaped cross-section as shown in FIG. 18. Further, as shown in FIG. 19, the pillar-like portion 19 may be smaller in diameter than a proximal portion 21 disposed adjacent to the smaller-diameter portion 20.

As described above in detail, in the present invention, there can be achieved excellent advantages that the amount of consumption of the electrode can be suppressed and that the required voltage can be decreased.

What is claimed is:

1. A spark plug for an internal combustion engine, comprising:

a central electrode; and an earth electrode disposed opposite to said central electrode on a longitudinal axis of said central electrode so as to form an unobstructed spark gap between said central electrode and said earth electrode;

wherein said central electrode is solid and includes a pillar-like portion provided at a discharge side thereof disposed close to said spark-gap, said pillar-like portion having a predetermined thickness corresponding to an intended lifetime of said spark plug;

wherein said central electrode also includes a smaller-diameter portion disposed adjacent to a non-discharge side of said pillar-like portion, said smaller-diameter portion having a smaller diameter portion than said pillar-like portion, wherein said pillar-like portion and said smaller-portion are interconnected in a step-like manner by a stepped portion; and wherein discharge is confined to the area between said stepped portion and an end face of the central electrode and said earth electrode.

2. A spark plug according to claim 1, in which said pillar-like portion has a uniform cross-sectional area in a direction of the axis of the said central electrode.

3. A spark plug according to claim 1, in which an outer periphery of said smaller-diameter portion extends over an entire periphery of said proximal end of said pillar-like portion.

4. A spark plug according to claim 1, in which a step formed between said pillar-like portion and said smaller-diameter portion has a radial dimension of not less than 0.1 mm, the thickness of said pillar-like portion being not more than 0.6 mm.

5. A spark plug according to claim 4, in which the following formulas are established:

$60° \leqq \theta 90°$ in the case of $W \leqq 0.2$ mm; and $30° \leqq \theta 90°$ in the case of $W > 0.2$ mm;

where W represents the radial dimension of said step between said pillar-like portion and said smaller-diameter portion, and $\theta$ represents an angle between a surface of said step and a line extending in the direction of the axis of said central electrode.

6. A spark plug for an internal combustion engine comprising:

a solid pillar-like central electrode; and an earth electrode disposed in opposed relation to said central electrode on a longitudinal axis of said central electrode to thereby form an unobstructed spark gap between said central electrode and said earth electrode;

said central electrode having a reduced intermediate diameter between opposite ends thereof to form a smaller-diameter portion, so that a discharge and portion of said central electrode disposed close to said earth electrode is formed into a pillar-like portion having a predetermined thickness corresponding to an intended lifetime of said spark plug; and said pillar-like portion and said earth electrode form a discharge therebetween.

7. A spark plug according to claim 6, wherein an interconnecting portion between said pillar-like portion and said smaller-diameter portion is formed as a step.

8. A spark plug according to claim 6, in which said pillar-like portion has a uniform cross-sectional area in a direction of the axis of said central electrode.

9. A spark plug for an internal combustion engine, comprising:

a central electrode; and an earth electrode disposed opposite to said central electrode on a longitudinal axis of said central electrode to thereby form an unobstructed spark gap between said central electrode and said earth electrode;

wherein said central electrode is solid and includes a pillar-like portion provided at a discharge end thereof disposed close to said spark gap, said pillar-like portion having a predetermined thickness corresponding to an intended lifetime of said spark plug;

wherein said central electrode includes a smaller-diameter portion disposed at a non-discharge end thereof, said smaller-diameter being smaller in diameter than said pillar-like portion; and wherein said central portion further includes a step portion, disposed between and interconnecting said pillar-like portion and said smaller-diameter portion, said step portion serving to limit the position of a spark discharge to be produced between said earth electrode and said step portion.

10. A spark plug according to claim 9, in which said pillar-like portion has a uniform cross-sectional area in a direction of the axis of said central electrode.

11. A spark plug for an internal combustion engine, comprising:

a central electrode; and an earth electrode disposed opposite to said central electrode on an axis of said central electrode so as to form a spark gap between said central electrode and said earth electrode;

wherein said central electrode includes a pillar-like portion provided at a discharge side thereof disposed close to said spark-gap, said pillar-like portion having a predetermined thickness corresponding to an intended lifetime of said spark plug;

wherein said central electrode also includes a smaller-diameter portion disposed adjacent to a non-discharge side of said pillar-like portion, said smaller-diameter portion having a smaller diameter portion than said pillar-like portion;

wherein said pillar-like portion and said smaller-portion are interconnected in a step-like manner so that a step is formed between said pillar-like portion and said smaller-diameter portion;

wherein said smaller-diameter portion has a radial dimension of not less than 0.1 mm, and the thickness of said pillar-like portion being not more than 0.6 mm; and wherein the following conditions are satisfied:

$60° \leqq \theta \leqq 90°$ when $W \leqq 0.2$ mm; and $30° \leqq \theta \leqq 90°$ when $W > 0.2$ mm;

where W represents the radial dimension of said step between said pillar-like portion and said smaller-diameter portion, and $\theta$ represents an angle between a surface of said step and a line extending in the direction of the axis of said central electrode.

* * * * *